US005382751A

United States Patent [19]

Kitayama et al.

[11] Patent Number: 5,382,751

[45] Date of Patent: Jan. 17, 1995

[54] ELECTRONIC MUSICAL INSTRUMENT INCLUDING A CONFIGURABLE TONE SYNTHESIZING SYSTEM

[75] Inventors: Toru Kitayama; Iwao Higashi, both of Hamamatsu, Japan

[73] Assignee: Yamaha Corporation, Japan

[21] Appl. No.: 983,874

[22] Filed: Dec. 1, 1992

[30] Foreign Application Priority Data

Dec. 27, 1991 [JP] Japan ..... 3-358910

[51] Int. Cl.[6] ..... G10H 1/12

[52] U.S. Cl. ..... 84/661; 84/DIG. 9; 84/DIG. 10

[58] Field of Search ..... 84/622-625, 84/659-661, 692-700, 736, DIG. 9, DIG. 10

[56] References Cited

U.S. PATENT DOCUMENTS

| | | | |
|---|---|---|---|
| Re. 31,004 | 8/1982 | Numi . | |
| 4,297,933 | 11/1991 | Nishimoto . | |
| 4,548,119 | 10/1985 | Wachi et al. | 84/DIG. 9 |
| 4,554,857 | 11/1985 | Nishimoto . | |
| 4,554,858 | 11/1985 | Wachi et al. | 84/DIG. 9 |
| 4,984,276 | 1/1991 | Smith . | |
| 5,182,415 | 1/1993 | Kunimoto | 84/660 |
| 5,187,313 | 2/1993 | Inoue | 84/622 |
| 5,241,127 | 8/1993 | Kobayashi et al. | 84/625 X |
| 5,248,844 | 9/1993 | Kunimoto | 84/622 |
| 5,256,830 | 10/1993 | Takeuchi et al. | 84/625 |

FOREIGN PATENT DOCUMENTS

| | | |
|---|---|---|
| 0393701 | 4/1990 | European Pat. Off. . |
| 0397149 | 5/1990 | European Pat. Off. . |
| 0459393 | 5/1991 | European Pat. Off. . |
| 58-48109 | 10/1983 | Japan . |
| 63-40199 | 2/1988 | Japan . |
| 1-137295 | 5/1989 | Japan . |

*Primary Examiner*—Stanley J. Witkowski
*Attorney, Agent, or Firm*—Graham & James

[57] ABSTRACT

An electronic musical instrument includes an excitation signal generating device, a plurality of loop circuits and a coupling circuit. The excitation signal generating device generates an excitation signal in accordance with musical tone designating information. Each of the plurality of loop circuits at least delays an input signal in response to the musical tone designating information and repeatedly circulates the input signal therein. The excitation signal generated by the excitation signal generating device is supplied to at least one of the plurality of loop circuits as an input signal. The coupling circuits couples the plurality of loop circuits in accordance with a predetermined coupling form. At least one signal circulated in at least one of the plurality of loop circuits is output as a musical tone signal to be generated. The electronic musical instrument further includes a memory circuit which stores a plurality of coupling forms. The coupling forms respectively indicates how to couple input and output terminals of the plurality of loop circuits. The input and output terminals are coupled to each other in accordance with one of the plurality of coupling forms.

6 Claims, 12 Drawing Sheets

ELECTRONIC MUSICAL INSTRUMENT INCLUDING A CONFIGURABLE TONE SYNTHESIZING SYSTEM

BACKGROUND OF THE INVENTION

1. Field of the Invention

The present invention relates to electronic musical instruments, and more particularly, to electronic musical instruments capable of generating varied musical tones like those of acoustic (non-electronic) musical instruments.

2. Prior Art

Due to recent technological improvements, tone generators employed in electronic musical instruments have come to be capable of synthesizing a wide variety of musical tones. For example, physical-modal tone-generators which synthesize sounds of acoustic musical instruments are conventionally known. Each of the physical-modal tone-generators simulates the sound production mechanism of a target acoustic musical instrument. Examples of the physical-modal tone-generators have been disclosed in Japanese Patent Application Laid-Open Publication No. 63-40199 and U.S. Pat. No. 4,984,276.

An example of conventional physical-modal tone-generators simulating the sound production mechanism of stringed instruments is shown in the block diagram of FIG. 19. In this figure, an excitation signal generating circuit 1 includes a waveform memory which stores excitation signal waveforms made up of a large number of frequency components, such as an impulse waveform. The excitation signal from the excitation signal generating circuit 1 is supplied to a first input terminal of an adder 2. The output signal from the adder 2 is supplied to a delay circuit 3 which simulates the delay of propagation of vibrating waves in a string of the target stringed instrument.

The delayed output signal from the delay circuit 3 is then supplied to a filter 4 which simulates acoustical losses of a vibrating string of the target stringed instrument. The output signal from the filter 4 is then supplied to a second input terminal of the adder 2. Elements 2 through 4 described above together form a closed loop. In addition to the delay circuit 3, the output signal from the adder 2 is supplied to a sound signal output terminal 5, whereby a signal circulating in the closed loop is output as a musical tone signal to be generated. With the conventional tone generator described above, when the excitation signal output from the excitation signal generating circuit 1 is supplied to the first input terminal of the adder 2, the supplied excitation signal begins to circulate in the closed loop. In this case, the signal circulates around the closed loop once in the time which is equal to the period of oscillation of the vibrating string being simulated, and the band width of the signal is limited by the filter 4 each time the signal passes through the filter 4. Then, the signal circulating in the closed loop is delivered as a musical tone signal from the musical tone output terminal 5. An example of the above-described type of tone generator has been disclosed in Japanese Patent Publication No. 58-48109.

In the above conventional electronic musical instrument comprising the above conventional tone generator, the variation of tone colors of the musical tones to be synthesized is limited and is a drawback in obtaining musical tone with a certain feeling of pitch and high quality, and in many cases where the pitch and the spectral construction of the excitation signal supplied to the closed loop must correspond to a pitch designated by a performer.

By increasing the loop gain of the closed loop (the filter with the comb-formed frequency characteristics), the comb-formed frequency characteristics of the entire closed loop for the signal circulating become sharper, so that the feeling of the pitch is improved. However, in this case, the stability of the operation of the closed loop decreases, and in the worst case, there is drawback in that the closed loop self-oscillates. Accordingly, there is a drawback in that the reliability of the system is degraded.

SUMMARY OF THE INVENTION

In consideration of the above, it is an objective of the present invention to provide an electronic musical instrument which is capable of generating the musical tone with a great variety of spectral constructions under no influence of the kind of the waveform of the excitation signal and with a rich variation of tone color of the musical tone, and which is capable of stable closed loop operation, and which is capable of constructing a system with high reliability.

To satisfy these objectives, the present invention provides an electronic musical instrument comprising an excitation signal generating means for generating an excitation signal in accordance with a musical tone designating information and a plurality of loop means for at least delaying an input signal in response to the musical tone designating information and repeatedly circulating the signal, so that the excitation signal is supplied to at least one of the plurality of loop means; and coupling means for coupling the plurality of loop means in accordance with a predetermined coupling form, wherein a signal circulated in at least one of the plurality of loop means is output as a musical tone signal.

According to such a structure, the plurality of loop means, which is coupled to each other in accordance with the predetermined coupling form, at least delays the supplied excitation signal in response to the musical tone designating information to and repeatedly circulates the signal. The signal gradually changes into a signal having a desirable waveform in response to the coupling form while circulating in the plurality of loop means. Accordingly, the signal circulated in one of any plurality of loop means is delivered as a musical tone signal.

According to the present invention, a positive effect is that the musical tone can be generated with a great variety of spectral constructions under no influence of the kind of the waveform of the excitation signal and with the rich variation of tone color of the musical tone. Furthermore, there is the positive effect that a system with high reliability can be constructed so that the closed loop operates stably.

DETAILED DESCRIPTION OF THE PREFERRED EMBODIMENTS

Figure 1:
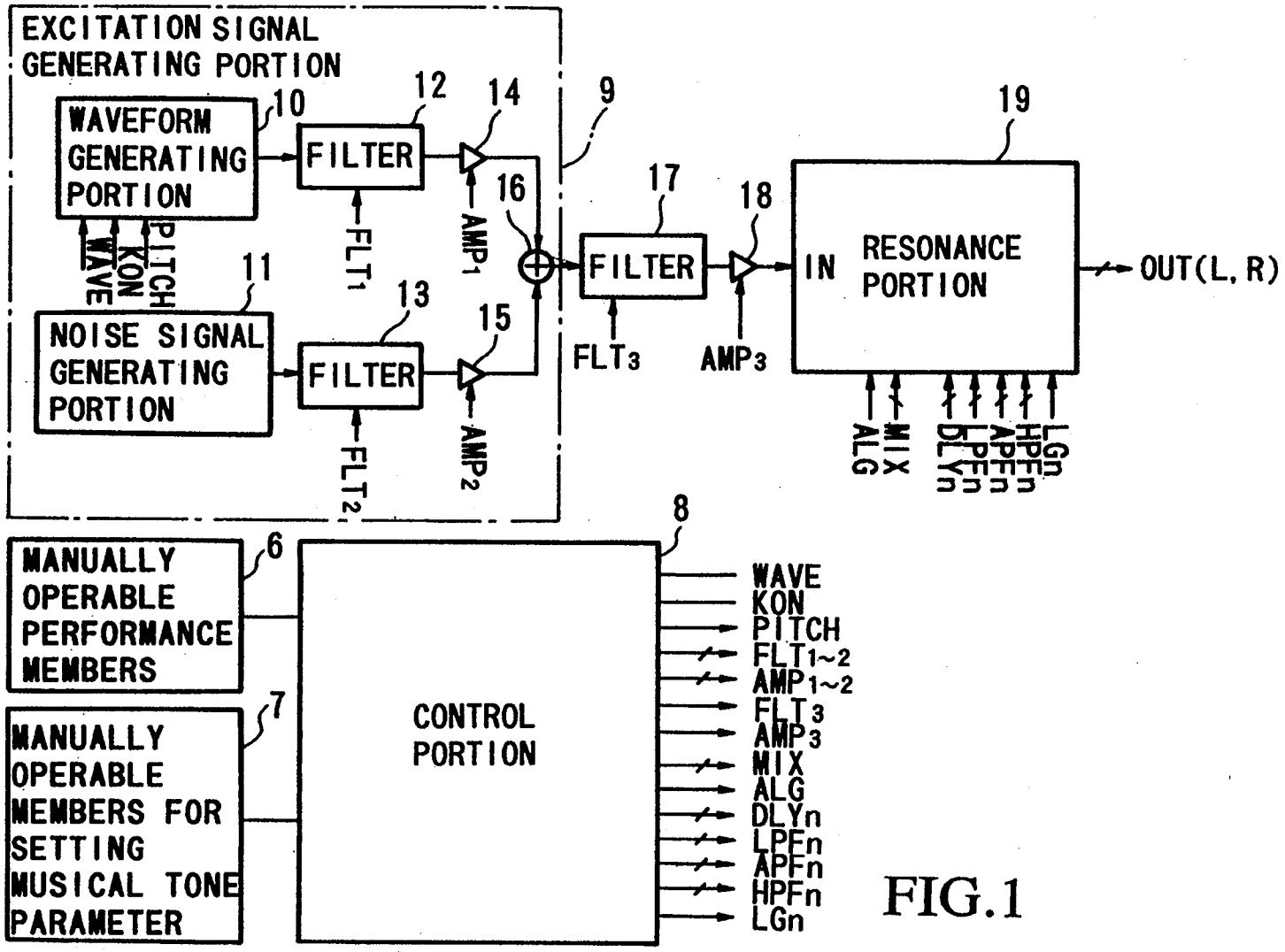
FIG. 1 shows a block diagram of the electrical structure of an electronic musical instrument based on the preferred embodiment of the present invention.

Hereinafter, an explanation of the preferred embodiment of the present invention is given with reference to the figures. FIG. 1 shows a block diagram of the structure of an electronic musical instrument in accordance with the preferred embodiment of the present invention. In this figure, manually operable performance members 6 such as a keyboard, manually operable members 7 for setting musical tone parameter designating a musical tone parameter such as a tone color, and a control portion 8 controlling all apparatuses, are provided.

Moreover, an excitation signal generating portion 9 is provided which comprises a waveform generating portion 10 which generates a signal including a rich overtone with the required waveform based on data WAVE for designating the waveform of the generated signal, a key-on signal KON for designating the generating timing of the generated signal and a pitch data PITCH for designating the pitch of the generated signal from the control portion 8. The excitation signal generating portion 9 further comprises a noise signal generating portion 11 which generates a noise signal such as a white noise signal; each of the filters 12 and 13 append the desired characteristics to the output signal from the waveform generating portion 10 and the noise signal generating portion 11 based on coefficient data $FLT_1$ and $FLT_2$ from the control portion 8, respectively. The output signal from the filter 12 is supplied to a multiplier 14 which multiplies it by an amplitude control signal $AMP_1$ from the control portion 8. The output signal from the filter 13 is supplied to a multiplier 15 which multiplies it by an amplitude control signal $AMP_2$ from the control portion 8. Each of the output signals from the multipliers 14 and 15 are supplied to first and second terminals of an adder 16 which adds the former and the later and delivers an excitation signal.

Furthermore, the output signal from the adder 16 of the excitation signal generating portion 9, namely the excitation signal, is supplied to a filter 17 which appends the desired characteristics to it based on the coefficient data $FLT_3$ from the control portion 8. The output signal from the filter 17 is supplied to a multiplier 18 which multiplies it by an amplitude control signal $AMP_3$ from the control portion 8. The output signal from the multiplier 18 is supplied to a resonance portion 19 which simulates the resonance phenomenon of the non-electronic musical instrument. The resonance portion 19 appends the desired characteristics to the output signal from the multiplier 18 based on data ALG for designating the combinations (the connection forms, namely algorithms) of a plurality of resonance elements (loop circuits described below) forming the resonance portion 19, data MIX for designating the synthesis coefficient for synthesizing the output signals from each of the loop circuits, data $DLY_n$ ($n=1$ through 4, etc.) corresponding to the delay period of each of the loop circuits, the coefficient $LPF_n$ of low pass filters (LPF) forming each of the loop circuits, the coefficient $APF_n$ of all pass filters (APF) forming each of the loop circuits, the coefficient $HPF_n$ of high pass filters (HPF) forming each of the loop circuits and loop gain $LG_n$ of each of the loop circuits, from the control portion 8. Thus, the resonance portion 19 delivers output signals as the musical tone signals of each of the channels L and R.

Figure 2:
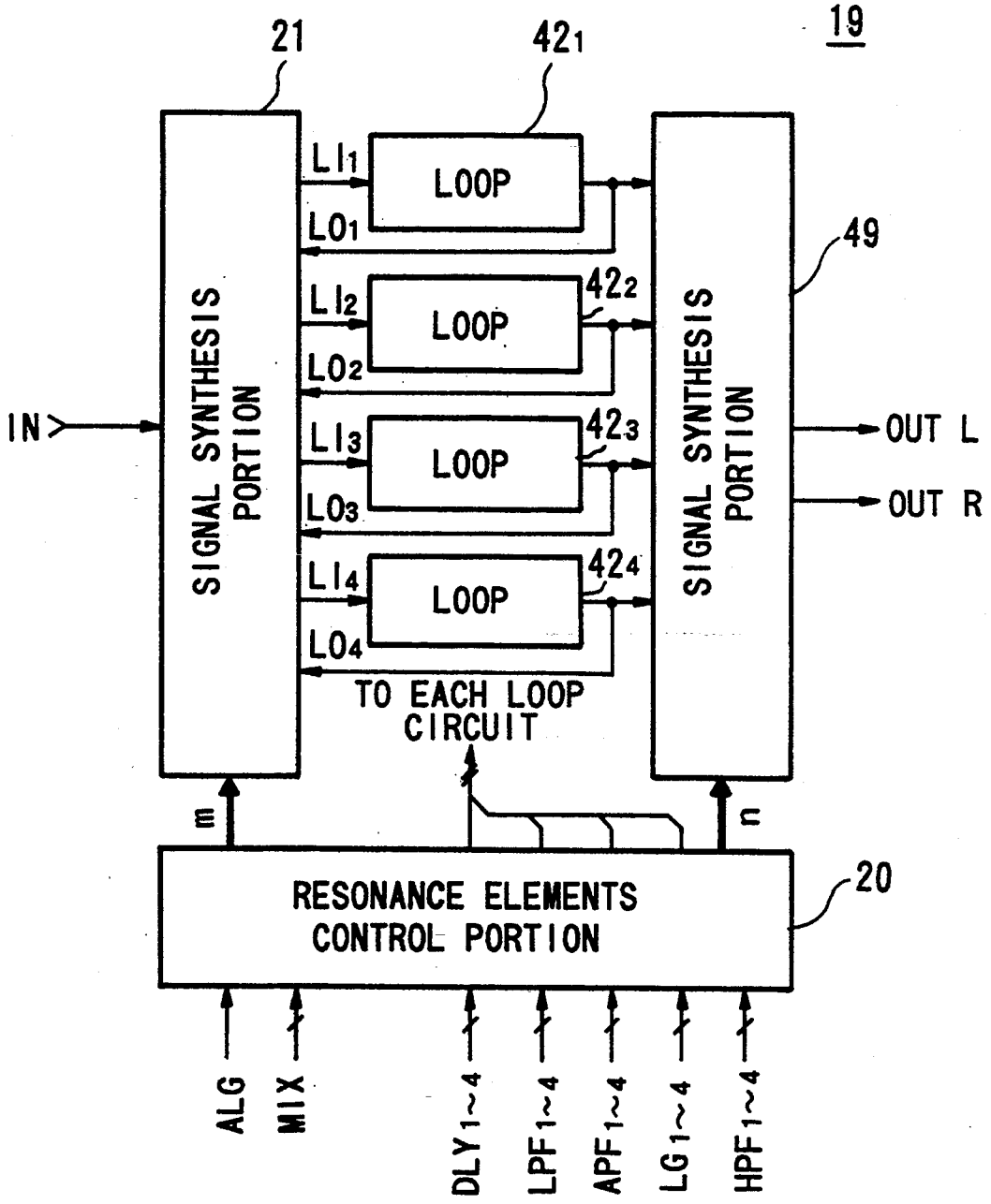
FIG. 2 shows a block diagram of the electrical structure of a resonance portion 19.
Figure 3:
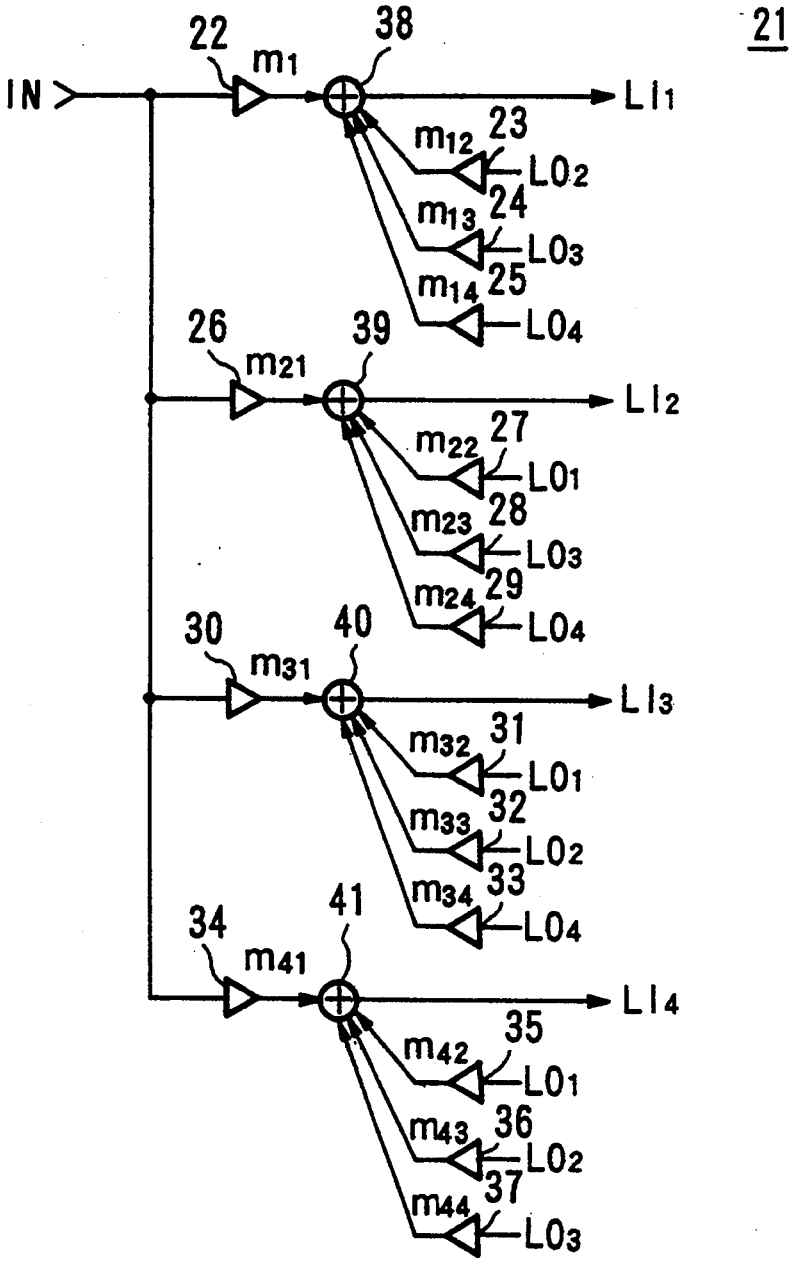
FIG. 3 shows a block diagram of the electrical structure of a signal synthesis portion 21.

The coefficient data $FLT_1$ through $FLT_3$ and the amplitude control signals $AMP_1$ through $AMP_3$ may be constant or variable over time. Next, FIG. 2 shows a block diagram of the electrical structure of the resonance portion 19. In this figure, a resonance elements control portion 20 is provided which determines multiplicative coefficients $m_{11}$ through $m_{14}$, $m_{21}$ through $m_{24}$, $m_{31}$ through $m_{34}$, and $m_{41}$ through $m_{44}$ of each of multipliers 22 through 37 (see FIG. 3) in a signal synthesis portion 21 based on the data ALG from the control portion 8 and delivers these to the multipliers 22 through 37. In FIG. 3, the multipliers 22, 26, 30, and 34 multiply input signals; that is, the output signal from the multiplier 18 shown in FIG. 1, by multiplicative coefficients $m_{11}$, $m_{21}$, $m_{31}$, and $m_{41}$, respectively. The multipliers 23 through 25 multiply output signals $LO_2$ through $LO_4$ from loop circuits $42_2$ through $42_{24}$ described below by multiplicative coefficients $m_{12}$ through $m_{14}$, respectively. An adder 38 adds the output signals from each of the multipliers 22 through 25 and delivers an output signal $LI_1$. The multipliers 27 through 29 multiply output signals $LO_1$, $LO_3$, and $LO_4$ from loop circuits $42_1$, $42_{23}$, and $42_{24}$ described below by multiplicative coefficients $m_{22}$ through $m_{24}$, respectively. An adder 39 adds the output signals from each of the multipliers 26 through 29 and delivers an output signal $LI_2$. The multipliers 31 through 33 multiply output signals $L0_1$, $L0_2$, and $L0_4$ from loop circuits $42_1$, $42_2$, and $42_4$ described below by multiplicative coefficients $m_{32}$ through $m_{34}$, respectively. An adder 40 adds the output signals from each of the multipliers 30 through 33 and delivers an output signal $LI_3$. The multipliers 35 through 37 multiply output signals $L0_1$ through $L0_4$ from loop circuits $42_1$ through $42_3$ described below by multiplicative coefficients $m_{42}$ through $m_{44}$, respectively. An adder 41 adds the output signals from each of the multipliers 34 through 37 and delivers an output signal $LI_4$. Thus, the signal synthesis portion 21 synthesizes the output signal from the multiplier 18 and the output signals from the loop circuits $42_1$ through $42_4$ and delivers the synthesized signals, namely, the output signals from the adders 38 through 41 to the loop circuits $42_1$ through $42_4$, respectively.

Figure 4:
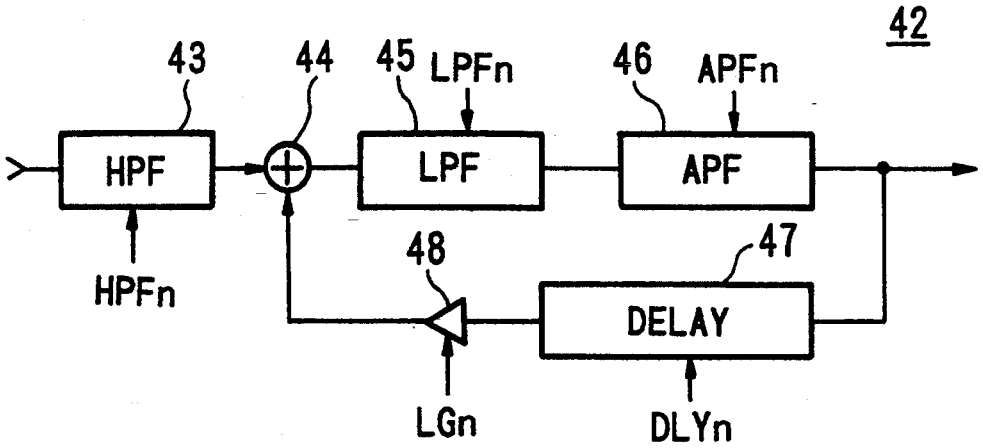
FIG. 4 shows a block diagram of the electrical structure of a LOOP 42.

In FIG. 2, the loop circuits (hereinafter referred to as LOOP) $42_1$ through $42_4$ having the same electrical structure are provided. FIG. 4 shows a block diagram of the electrical structure of the LOOP 42. In this figure, a high pass filter (HPF) 43 is provided, which cuts off the low frequency component of an input signal, that is, the output signal LI from the signal synthesis portion 21 based on a coefficient $HPF_n$ from the control portion 8 via the resonance elements control portion 20. The output signal from the HPF43 is supplied to a first input terminal of an adder 44. The output signal from the adder 44 is supplied to a low pass filter (LPF) 45 which cuts off the high frequency component of it based on a coefficient $LPF_n$ from the control portion 8 via the resonance elements control portion 20. The output signal from the LPF 45 is supplied to an all-pass filter (APF) 46 in which the phase difference between an input signal and an output signal changes in response with the frequency of the signals based on a coefficient $APF_n$ from the control portion 8, via the resonance elements control portion 20. The output signal from the APF 46 is supplied to a delay circuit (DELAY) 47 which delays it for the desired delay period based on data $DLY_n$ from the control portion 8, via the resonance elements control portion 20. The output signal from the DELAY 47 is supplied to a multiplier 48 which multiples it by a loop gain $LG_n$ from the control portion 8, via the resonance elements control portion 20. The resonance frequency pitches of each of the LOOPs $42_1$ through $42_4$ are decided by the total sum of the delay time of each of the LPF 45, the APF 46 and the DELAY 47 which is the construction element in the closed loop, that is, the total sum of the delay period of the closed loop. Accordingly, the delay period of the DELAY 47 must be designated based on the data $DLY_n$ in consideration of the delay characteristics of the filters (i.e., the LPF45 and the APF46) in the closed loop to control the tone pitch.

Figure 5:
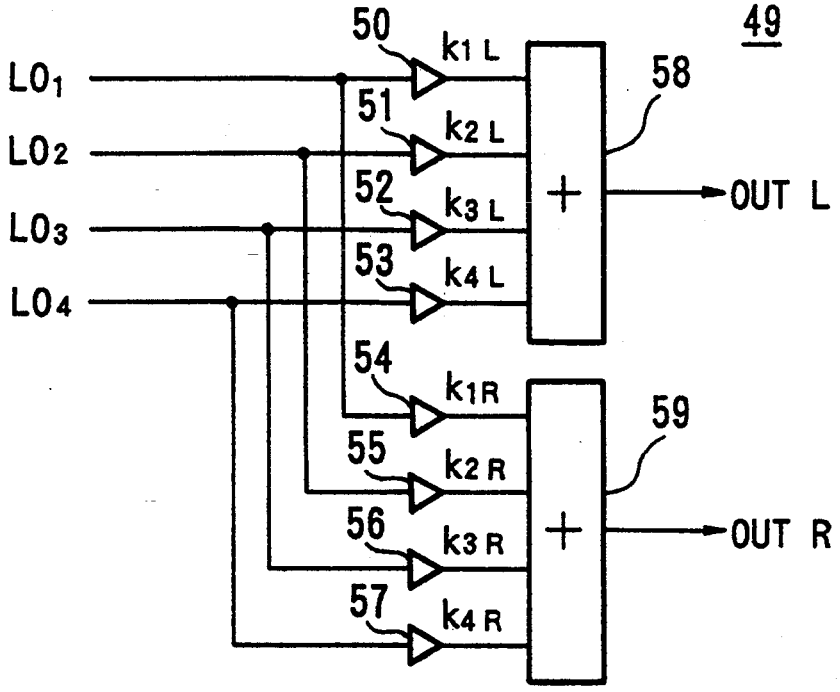
FIG. 5 shows a block diagram of the electrical structure of a signal synthesis portion 49.
Figure 6A:
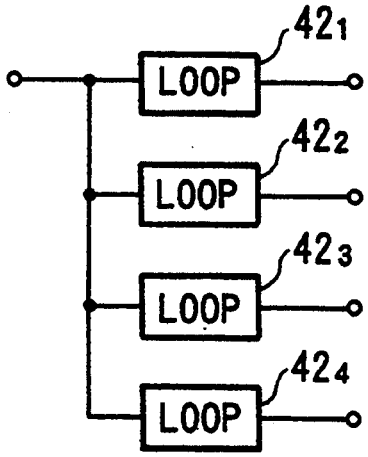
FIGS. 6(A) through 9 show block diagrams of examples of the algorithms constructed by the LOOPs $42_1$ through $42_4$.
Figure 6B:
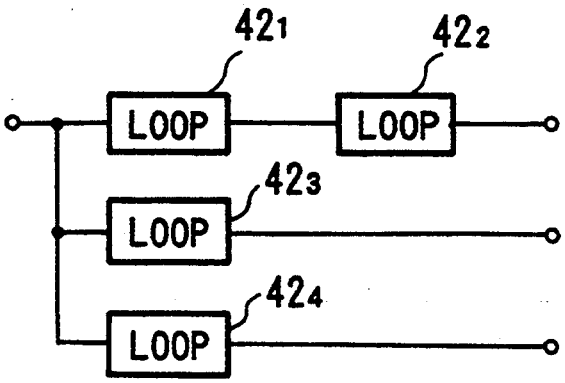
Figure 6C:
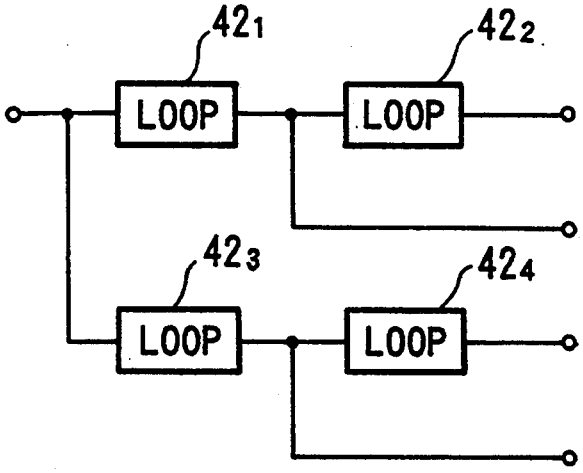
Figure 7A:
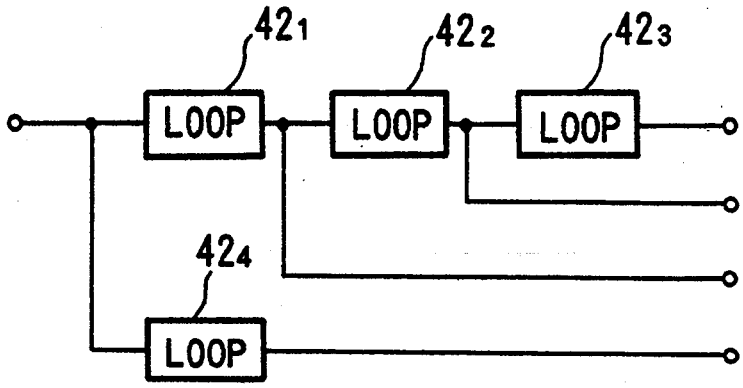
Figure 7B:
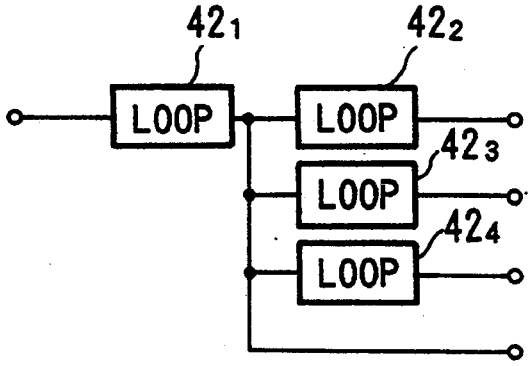
Figure 7C:
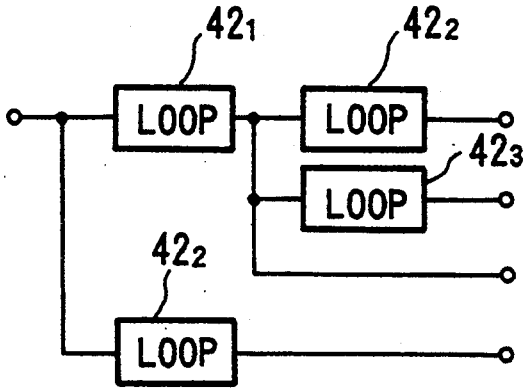
Figure 8A:
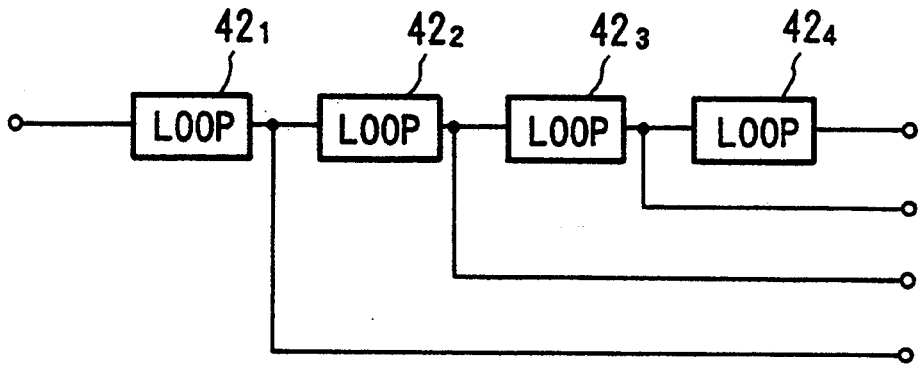
Figure 8B:
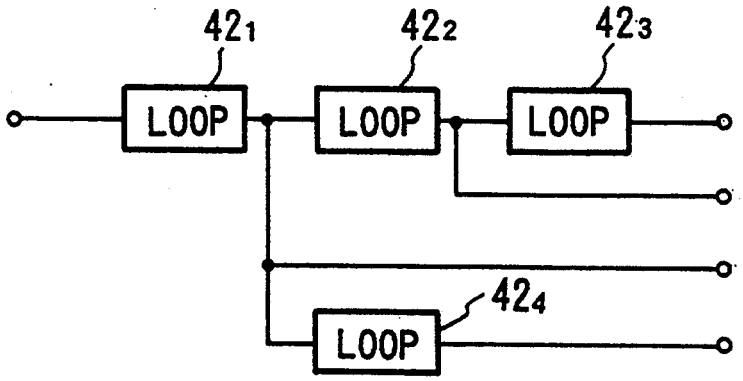

Moreover, in FIG. 2, a signal synthesis portion 49 is provided which synthesizes the output signals from each of the LOOPs $42_1$ through $42_4$ and delivers output signals as the musical tone signals of each of the channels L and R. The resonance elements control portion 20 decides multiplicative coefficients $k_{1L}$ through $k_{4L}$, and $k_{1R}$ through $k_{4R}$, of each of the multipliers 50 through 57 (see FIG. 5) in a signal synthesis portion 49 based on the data MIX from the control portion 8 and delivers these to the multipliers 50 through 57. In FIG. 5, the multipliers 50 and 54 multiply input signals, namely, the output signal from the LOOP $42_1$ shown in FIG. 2 by multiplicative coefficients $k_{1L}$ and $k_{1R}$, respectively. The multipliers 51 and 55 multiply input signals, namely, the output signal from the LOOP $42_2$ shown in FIG. 2 by multiplicative coefficients $k_{2L}$ and $k_{2R}$, respectively. The multipliers 52 and 56 multiply input signals, namely, the output signal from the LOOP $42_3$ shown in FIG. 2 by multiplicative coefficients $k_{3L}$ and $k_{3R}$, respectively. The multipliers 53 and 57 multiply input signals, namely, the output signal from the LOOP $42_4$ shown in FIG. 2 by multiplicative coefficients $k_{4L}$ and $k_{4R}$, respectively. The adder 58 is provided which adds the output signal from the multipliers 50 through 53 and delivers the additional result as the musical tone signal OUTL of the channel L. The adder 59 is provided which adds the output signal from the multipliers 54 through 57 and delivers the additional result as the musical tone signal OUTR of the channel R.

When the control portion 8 delivers one data ALG to designate the combinations (the connection forms, namely algorithms) of the LOOPs $42_1$ through $42_4$, the resonance elements control portion 20 determines the multiplicative coefficients $m_{11}$ through $m_{14}$, $m_{21}$ through $m_{24}$, $m_{31}$ through $m_{34}$, and $m_{41}$ through $m_{44}$ of each of multipliers 22 through 37 in the signal synthesis portion 21 (shown in FIG. 3) based on the data ALG and delivers these to the multipliers 22 through 37. Accordingly, the algorithm (the connection form) of the LOOPs $42_1$ through $42_4$ are, for example, designated as shown in FIGS. 6(A) through 6(C), 7(A) through 7(C), 8(A), and 8(B). Next, when the control portion 8 delivers one data MIX to designate the synthesis coefficient of the output signal from each of the LOOPs $42_1$ through $42_4$, the resonance elements control portion 20 decides the multiplicative coefficients $k_{1L}$ through $k_{4L}$, and $k_{1R}$ through $k_{4R}$, of each of the multipliers 50 through 57 in the signal synthesis portion 49 (shown in FIG. 5) based on the data MIX and delivers these to the multipliers 50 through 57. Accordingly, the output signals from the algorithm of the LOOPs $4_{21}$ through $4_{24}$, for example, as shown in FIGS. 6(A) through 6(C), 7(A) through 7(C), 8(A), and 8(B), are variously synthesized over great range.

As described above, when the control portion 8 delivers the data ALG and MIX to the resonance portion 19, the combination of the LOOPs $42_1$ through $42_4$ of the resonance portion 19 can be variously constructed over great range.

Figure 9:
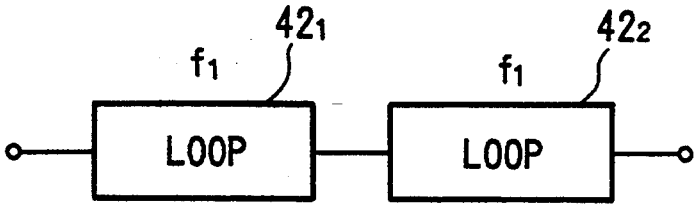

When synthesizing musical tones with a certain feeling of the pitch and with high quality, the control portion 8 delivers the data ALG and MIX to the resonance portion 19 to connect the LOOPs $42_1$ and $42_2$ in series as shown in FIG. 9. When the performer depresses, for example, the key of the keyboard of the performance manually operable member 6 corresponding to the note C, the keyboard delivers key data such as the tone pitch corresponding to the note C. The input portion of the touch (not shown) detects the initial touch and the after touch of each of the keys of the keyboard, and generates the touch data indicating the force of the touch and delivers these to the control portion 8. Then, the control portion 8 delivers the loop gain $LG_1$ and $G_2$, the coefficient $LPF_1$ and $LPF_2$, the coefficient $APF_1$ and $APF_2$, and the coefficient $HPF_1$ and $HPF_2$ for the key data, the touch data, the tone color and the like corresponding to C note to the resonance portion 19 to designate the fundamental frequency pitch of each of the LOOP $42_1$ and $42_2$ to the frequency f1. In addition, the control portion 8 delivers to the resonance portion 19 the resultant value which the above-mentioned value; such as the delay period of the LPF 45 and the APF 46; are subtracted from the phase delay period of the entire loop (see FIG. 9) corresponding to the note C as the delay period of the DELAY 47. Accordingly, the resonance elements control portion 20 in the resonance portion 19 delivers these data to the HPF43, the LPF45, the APF46, the DELAY47, and the multiplier 48 of each of the LOOPs $42_1$ and $42_2$.

Next, the control portion 8 delivers the data WAVE, the key-on signal KON and the pitch data PITCH to the waveform generating portion 10 in the excitation signal generating portion 9 and delivers the coefficient data $FLT_1$ and $FLT_2$ to the filters 12 and 13, respectively and delivers the amplitude control signals $AMP_1$ and $AMP_2$ to the multipliers 14 and 15, respectively. In this case, the amplitude control signals $AMP_1$ and $AMP_2$ are designated so that the ratio of the output signal from the filter 12 to the output signal from the filter 13 becomes higher. Furthermore, the control portion 8 supplies the coefficient data $FLT_3$ to the filter 17 and supplies the amplitude control signals $AMP_3$ to the multiplier 18.

Thus, the waveform generating portion 10 generates the generated signal having the waveform designated by the data WAVE with the generating timing designated by the key-on signal KON and the pitch designated by the pitch data PITCH and supplies it to the filter 12. The filter 12 appends the desired characteristics to the generated signal based on the coefficient data $FLT_1$. The multiplier 14 multiplies the output signal from the filter 12 by the amplitude control signal $AMP_1$. In contrast, the filter 13 appends the desired characteristics to the noise signal, such as white noise signal from the noise generating portion 11, based on the coefficient data $FLT_2$. The multiplier 15 multiplies the output signal from the filter 13 by the amplitude control signal $AMP_2$. Then, the adder 16 adds the output signals from the multipliers 14 and 15 and delivers the resultant signal as the excitation signal to the filter 17.

Next, the filter 17 appends the desired characteristics to the excitation signal based on the coefficient data $FLT_3$ from the control portion 8. The multiplier 18 multiplies the output signal from the filter 17 by the amplitude control signal $AMP_3$ from the control portion 8 and supplies its output signal to the resonance portion 19. Accordingly, in the resonance portion 19, the HPF 43 in the LOOP $42_1$ cuts off the low frequency component of the input signal, that is, the output signal from the multiplier 18 based on the coefficient $HPF_n$ from the control portion 8 via the resonance elements control portion 20. The output signal from the HPF 43 is supplied to the first input terminal of the adder 44. The output signal from the adder 44 is fed back to the second terminal of the adder 44 via the LPF 45, the APF 46, and the multiplier 48. Thus, the phase difference between each of the frequency components of the output signal from the HPF 43 varies and the level of the output signal from the HPF 43 gradually decreases as the output signal of the HPF 43 repeatedly circulates in the closed loop formed by the adder 44, the LPF 45, the APF 46, the DELAY 47 and the multiplier 48. Next, in the LOOP 422, the output signal from the APF 46 of the LOOP 421, namely, the output signal $LO_1$ from the LOOP $42_1$ is supplied to the LOOP $42_2$ and is treated in the same way as in the LOOP $42_1$. Accordingly, the output signal from the APF 46 of the LOOP $42_2$, in other words, the output signal $LO_2$ from the LOOP $42_2$ is supplied to the signal synthesis portion 49. The signal synthesis portion 49, that is, the resonance portion 19 delivers the output signals as the musical tone signals OUTL and OUTR of each of the channels L and R.

Figure 10:
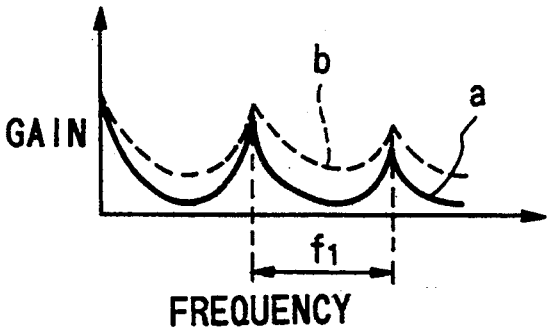
FIG. 10 shows an example of the frequency characteristics corresponding to the block diagram of FIG. 9.

As described above, since the resonance portion 19 comprises the LOOPs $42_1$ and $42_2$ connected in series and the fundamental frequency pitch of each of the LOOPs $42_1$ and $42_2$ is designated to the frequency f1, the frequency characteristic of the whole resonance portion 19 becomes the frequency characteristic of the curve a shown in FIG. 10. In FIG. 10, curve b shows the frequency characteristic of each of the LOOPs $42_1$ or $42_2$ and the frequency interval $f_I$ is one which the human ear recognizes as the pitch. As shown by FIG. 10, in the case where the LOOPs $42_1$ and $42_2$ having approximately the same frequency characteristics and are connected in series, the comb-formed frequency characteristic as a whole becomes sharper than one of each of the LOOPs $42_1$ or $42_2$, and a musical tone with a certain feeling of the pitch and with high quality can be synthesized.

The musical tone made using a non-electronic musical instrument not only hays a simple line spectrum, but also has a spectrum in which the noisy components lie near the original overtone, and furthermore contains irregularities. For example, in the case where the electronic musical instrument of the above-mentioned embodiment synthesizes similar musical tones to the musical tone having irregularities made using the non-electronic musical instrument, the control portion 8 may designate the amplitude control signals $AMP_1$ and $AMP_2$ so that the ratio of the output signal from the filter 13 to the output signal from the filter 12 becomes higher.

Figure 11:
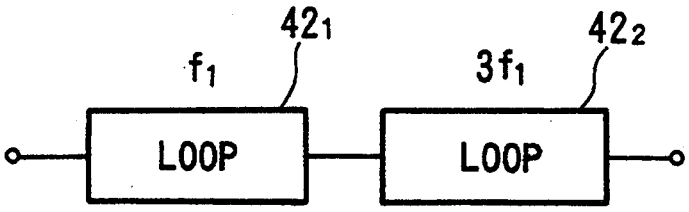
FIG. 11 shows a block diagram of other example of the algorithm constructed by the LOOPs $42_1$ through $42_4$.
Figure 12:
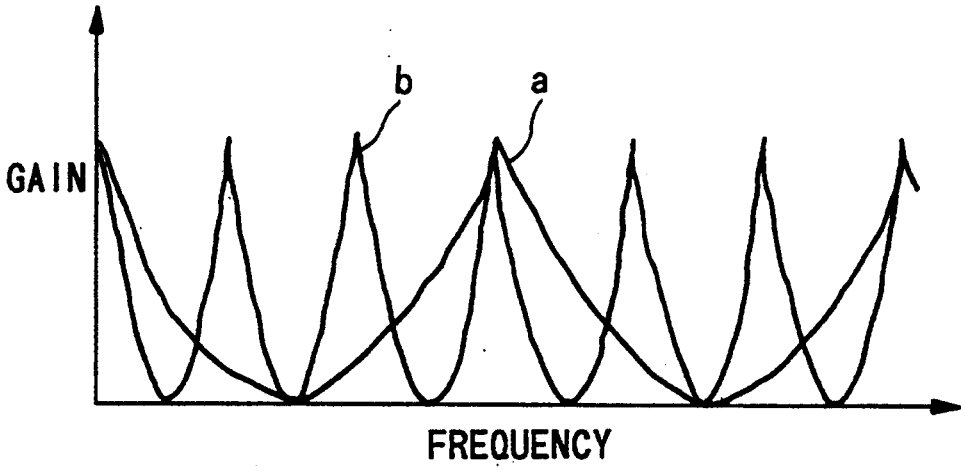
FIG. 12 shows an example of the frequency characteristics corresponding to each of the LOOPs $42_1$ and $42_2$ of FIG. 11.
Figure 13:
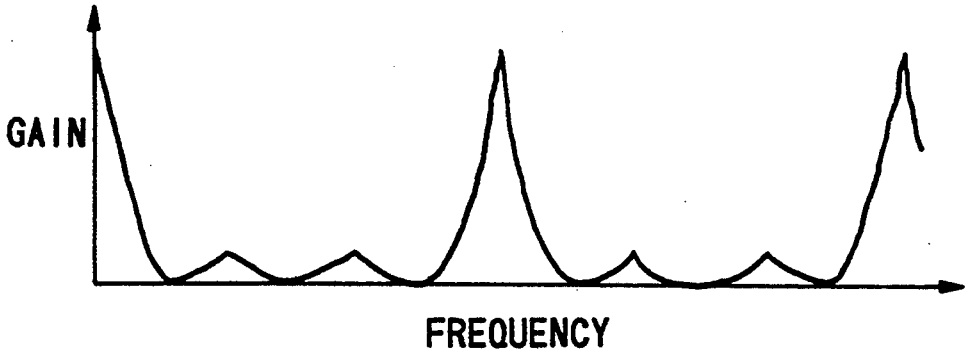
FIG. 13 shows an example of the frequency characteristics corresponding to the block diagram of FIG. 11.

When the resonance portion 19 comprises a similar connection to the one shown in FIG. 9, the fundamental frequency pitch of the LOOP $42_1$ is designated as the frequency $f_1$ (see curve a in FIG. 12), the fundamental frequency pitch of the LOOP $42_2$ is designated to the frequency $3f_1$ (see curve b in FIG. 12) as shown in FIG. 11, and the frequency characteristic of the whole resonance portion 19 becomes the frequency characteristic as shown in FIG. 13.

Figure 14:
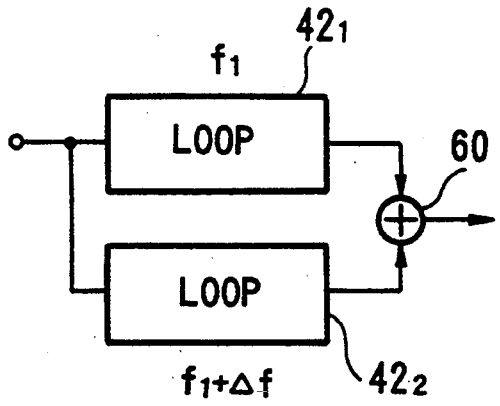
FIG. 14 shows a block diagram of other example of the algorithm constructed by the LOOPs $42_1$ through $42_4$.
Figure 15:
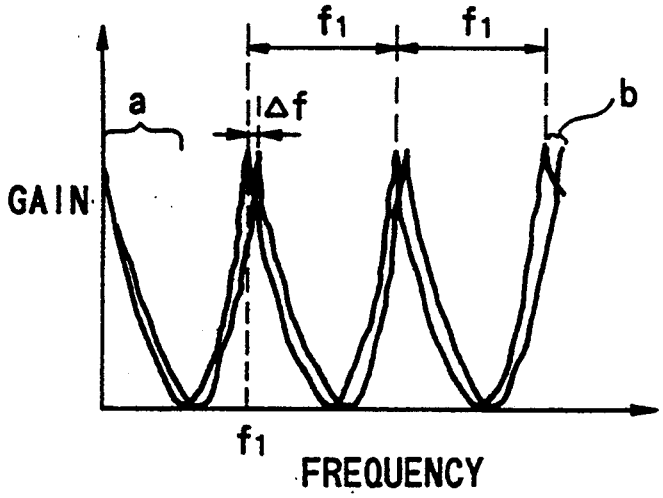
FIG. 15 shows an example of the frequency characteristics corresponding to the block diagram of FIG. 14.

When the resonance portion 19 comprises further the LOOPs $42_1$ and $42_2$ connected in parallel and an adder 60 adding the output signals from each of the LOOPs $42_1$ and $42_2$ as shown in FIG. 14, the fundamental frequency pitch of the LOOP $42_1$, which corresponds to the delay period of the LOOP 42, is designated to the frequency $f_1$, and the fundamental frequency pitch of the LOOP $42_2$ is designated to the frequency which shifts by the frequency $\Delta f$ against the frequency $f_1$. The frequency characteristic of the whole resonance portion 19 becomes somewhat similar to the frequency characteristic which both of the fundamental frequency pitch and the overtone frequency shift, as shown by the curve b in FIG. 15. Accordingly, the electronic musical instrument of the above-mentioned embodiment can synthesize the musical tone with a detuning effect in which the musical interval is finely shifted and with the sound effects of a chorus. In FIG. 15, the frequency component of curve a is practically removed by the HPF 43 (see FIG. 4) in the LOOP 42.

Figure 16:
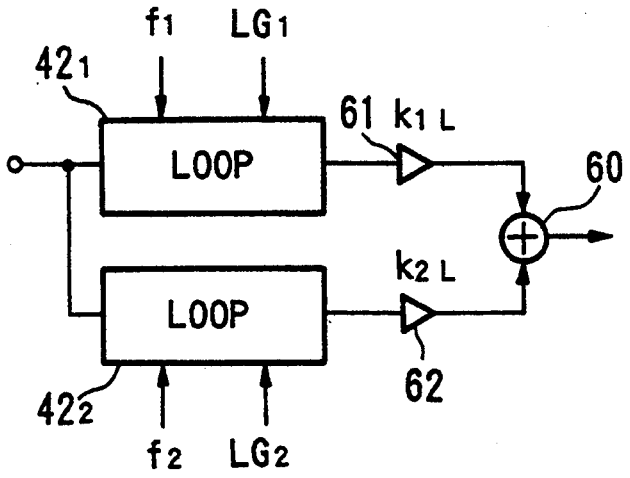
FIG. 16 shows a block diagram of other example of the algorithm constructed by the LOOPs $42_1$ through $42_4$.
Figure 17:
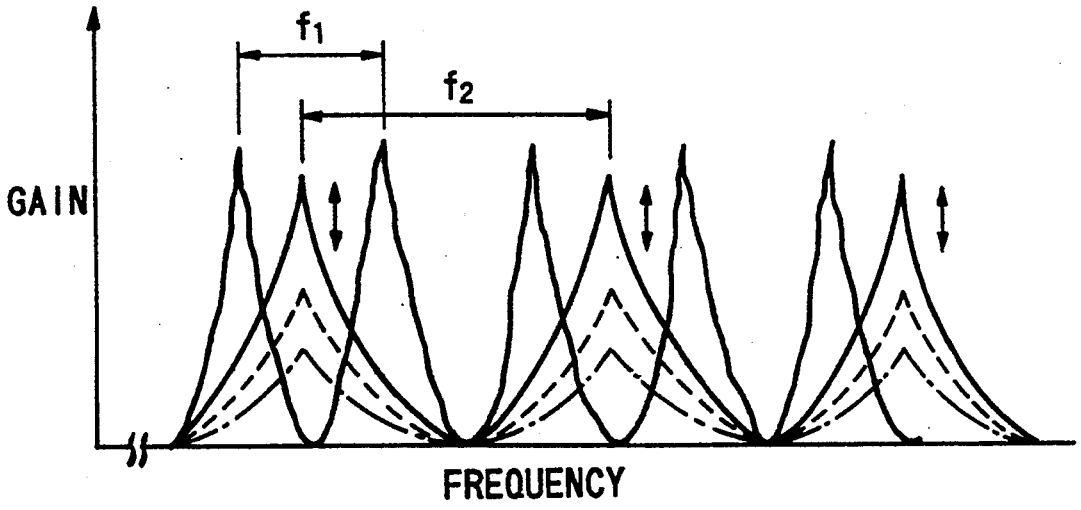
FIG. 17 shows an example of the frequency characteristics corresponding to the block diagram of FIG. 16.

Moreover, the resonance portion 19 is constructed as a construction in which the LOOPs $42_1$ and $42_2$ are connected in parallel, a multiplier 61 multiples the output signal from the LOOP $42_1$ by a multiplicative coefficient $k_{L1}$, a multiplier 62 multiples the output signal from the LOOP $42_2$ by a multiplicative coefficient $k_{L2}$ and an adder 60 adds the output signals from each of the multipliers 61 and 62 as shown in FIG. 16. The multipliers 61 and 62 correspond to the multiplier 48 and 50 through 57 in the signal synthesis portion 49 shown in FIGS. 2 and 5. When the fundamental frequency pitch $f_1$ and $f_2$ of each of the LOOPs $42_1$ and $42_2$, which corresponds to each of the data $DLY_1$ and $DLY_2$, and the loop gain $LG_1$ and $LG_2$ are adjusted and the output levels of each of the LOOPs $42_1$ and $42_2$ is adjusted by modifying the multiplicative coefficients $k_{L1}$ and $k_{L2}$, the specific row of the overtone component appearing in every pitch difference between the fundamental frequency pitches $f_1$ and $f_2$ can be independently controlled in every row. For example, when the loop gain $LG_2$ of the LOOP $42_2$ and the multiplicative coefficient $k_{L2}$ of the multiplier 62 are adjusted, the gain can be independently controlled every row of each of the overtone components as shown by the arrow in FIG. 17; thus, the musical tone having the desired overtone construction can be obtained.

As described above, since the resonance portion 19 is constructed so that the LOOPs $42_1$ through $42_4$ can be combined at random, the rich variation of tone color of the musical tone can be ensured. Since each of the LOOPs $42_1$ through $42_4$ can be usable in the range of stable operation, the reliability of the system becomes high. In particular, when the serial connection and the parallel connection of the LOOP 42 are included as shown in FIG. 6(B), FIG. 6(C), FIGS. 7(A) through 7(C), and FIG. 8(B), the tone color and the variation of the tone color of the generated musical tone can be more varied.

As the above-mentioned embodiment of the present invention, the overtone construction of the generated musical tone is more easily anticipated than in the tone generating form using modulation such as the frequency modulated tone generating circuit, and the number of calculations is far less than in the tone generating form using the harmonic synthesizing form (Fourier synthesizing form).

Moreover, in the above-mentioned embodiment of the present invention, the sampling of the musical tone data with high quality and the waveform memory with large volume are not particularly necessary such as in an electronic musical instrument using the tone-generating circuit which reads the waveform data from the waveform memory.

Figure 18:
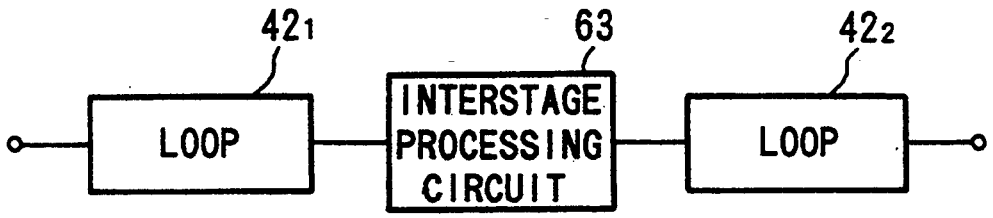
FIG. 18 shows a block diagram of another electrical structure of the resonance portion 19.
Figure 19:
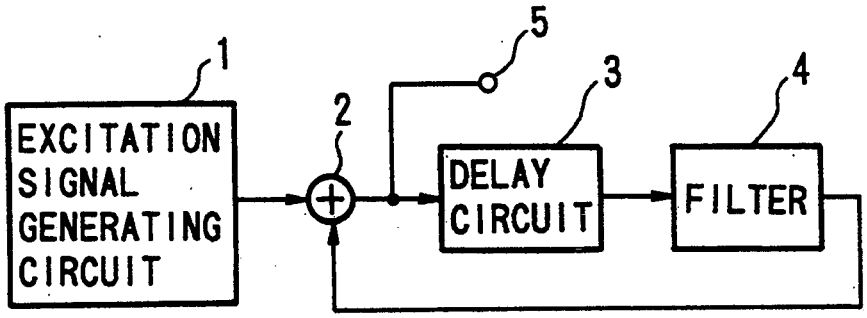
FIG.19 (PRIOR ART)
FIG. 19 shows a block diagram of a structural example of the conventional physical-modal tone-generator simulating a stringed instrument.

In the above-mentioned embodiment of the present invention, it is described that the resonance portion 19 is simply constructed by a combination of the LOOPs $42_1$ through $42_4$; however, for example, the resonance portion 19 may be constructed in which an interstage process circuit 63 is inserted between the LOOP $42_1$ and the LOOP $42_2$ as shown in FIG. 18. In this case, as the interstage process, for example, the following processes can be employed.

The processes are ones in which the output signal from the LOOP $42_1$ is nonlinearly processed using a nonlinear table, in which the amplitude of the output signal from the LOOP $42_1$ is controlled using such as a compressor or a limiter, or in which the sound effects of every kind such as reverberation, delay, and chorus is given for the output signal from the LOOP $42_1$.

In the above-mentioned embodiment of the present invention, it is described that the LOOPs $42_1$ and $42_4$ are combined so that the resonance elements control portion 20 determines the multiplicative coefficients $m_{11}$ through $m_{14}$, $m_{21}$ through $m_{24}$, $m_{31}$ through $m_{34}$, and $m_{41}$ through $m_{44}$, of each of the multipliers 22 through 37 of the signal synthesis portion 21 based on the data ALG from the control portion 8 and supplied to these; however, the present invention is not limited by the above-mentioned embodiment. For example, the LOOPs $42_1$ and $42_4$ may be combined so that an internal memory in which is pre-stored a plurality of the algorithms of the LOOPs $42_1$ and $42_4$ is provided in the control portion 8 and a performer selects one of these algorithms using the selection switch (not shown); thereby, the control portion 8 supplies the selected algorithm to the resonance elements control portion 20.

In the above-mentioned embodiment of the present invention, circuits corresponding to an excitation signal generating means, a plurality of loop means and coupling means in claims preferably consist of digital signal processors, respectively.

What is claimed is:

1. An electronic musical instrument comprising:

musical tone designation means for generating musical tone designating information;

excitation signal generating means for generating an excitation signal in accordance with said musical tone designating information;

a plurality of loop means for circulating an input signal therein, each loop means including an independently controllable delay means for delaying said circulating input signal in response to a pitch of a musical tone to be generated, wherein said excitation signal is supplied to at least one of said plurality of loop means;

coupling designation means for generating coupling designation data in accordance with a tone color of the musical tone to be generated; and coupling means for coupling said plurality of loop means in accordance with said coupling designation data, wherein a signal circulated in at least one of said plurality of loop means is output as a musical tone signal.

2. An electronic musical instrument according to claim 1, wherein said plurality of loop means each further include input and output terminals, wherein said input and output terminals of each of said plurality of loop means are coupled with each other in accordance with said coupling designation data.

3. An electronic musical instrument according to claim 1, wherein said coupling designation means includes memory means for storing a plurality of coupling forms indicating how to couple respective input and output terminals of each of said plurality of loop means, wherein said coupling means couples said respective input and output terminals of said plurality of loop means in accordance with a coupling form read from said memory means.

4. An electronic musical instrument comprising:

musical tone designation means for generating musical tone designating information;

excitation signal generating means for generating an excitation signal in accordance with said musical tone designating information;

a plurality of loop means for circulating an input signal therein, each loop means including an independently controllable delay means for delaying said circulating input signal in response to a pitch of a musical tone to be generated, wherein said excitation signal is supplied at least one of said plurality of loop means;

coupling designation means for generating coupling designation data in accordance with a tone color of the musical tone to be generated; and coupling means for coupling said plurality of loop means in series in accordance with said coupling designation data, wherein a signal circulated in at least one of said plurality of loop means is output as a musical tone signal.

5. An electronic musical instrument comprising:

musical tone designation means for generating musical tone designating information;

excitation signal generating means for generating an excitation signal in accordance with said musical tone designating information;

a plurality of loop means for circulating an input signal therein, each loop means including an independently controllable delay means for delaying said circulating input signal in response to a pitch of a musical tone to be generated, wherein said excitation signal is supplied to at least one of said plurality of loop means;

coupling designation means for generating coupling designation data in accordance with a tone color of the musical tone to be generated; and coupling means for coupling said plurality of loop means in parallel in accordance with said coupling designation data, wherein a signal circulated in at least one of said plurality of loop means is output as a musical tone signal.

6. An electronic musical instrument comprising;

musical tone designation means for generating musical tone designating information;

excitation signal generating means for generating an excitation signal in accordance with said musical tone designating information;

a plurality of loop means for circulating an input signal therein, each loop means including an independently controllable delay means for delaying said input signal in response to a pitch of a musical tone to be generated, wherein said excitation signal is supplied to at least one of said plurality of loop means;

coupling designation means for generating coupling designation data in accordance with a tone color of the musical tone to be generated; and coupling means for coupling said plurality of loop means in series and in parallel in accordance with said coupling designation data, wherein a signal circulated in at least one of said plurality of loop means is output as a musical tone signal.

* * * * *